US012616311B2

(12) United States Patent
Kappenman

(10) Patent No.: US 12,616,311 B2
(45) **Date of Patent: *May 5, 2026**

(54) SYSTEM AND METHOD FOR CUSTOMIZING A MATTRESS

(71) Applicant: Bed Patent Holdings Limited Liability Company, Las Vegas, NV (US)

(72) Inventor: Kevin J. Kappenman, Huntington Beach, CA (US)

(73) Assignee: Bed Patent Holdings Limited Liability Company, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/778,372

(22) Filed: Jul. 19, 2024

(65) Prior Publication Data

US 2024/0374042 A1 Nov. 14, 2024

Related U.S. Application Data

(63) Continuation-in-part of application No. 17/562,576, filed on Dec. 27, 2021, now Pat. No. 12,022,957.

(51) Int. Cl.
*A47C 27/06* (2006.01)
*A47C 27/05* (2006.01)

(52) U.S. Cl.
CPC ..... *A47C 27/062* (2013.01); *A47C 27/056* (2013.01); *A47C 27/064* (2013.01)

(58) Field of Classification Search
CPC ... A47C 27/062; A47C 27/056; A47C 27/064; A47C 17/86; A47C 27/22; A47C 27/085;
(Continued)

(56) References Cited

U.S. PATENT DOCUMENTS 6,061,856 A * 5/2000 Hoffmann ..... A47C 27/148 5/724
12,022,957 B2 * 7/2024 Kappenman ..... A47C 27/15
(Continued)

FOREIGN PATENT DOCUMENTS

EP 1149547 A1 * 10/2001 ..... A47C 27/20
EP 2850976 A1 * 3/2015 ..... B68G 11/04

*Primary Examiner* — Matthew Troutman
*Assistant Examiner* — Alison N Labarge
(74) *Attorney, Agent, or Firm* — Blue Capital Law Firm, P.C.

(57) ABSTRACT

A mattress includes a first layer, a second layer, and a third layer having a substantially arch shape. The third layer includes a first portion extending in a longitudinal direction from a location proximate to a first longitudinal end towards a second longitudinal end and completely embedded, in a vertical direction, inside the first layer. A second portion extending in a longitudinal direction from the first portion towards the second longitudinal end and at least a part of a length of the second portion is completely embedded, in the vertical direction, inside the second layer. The third layer includes one of a plurality of coils arranged in a grid pattern, a plurality of cavities arranged in a grid pattern, a non-woven thermoplastic sheet having heat bonded strands, or a woven thermoplastic sheet having heat bonded strands.

10 Claims, 9 Drawing Sheets

(58) Field of Classification Search
CPC ..... A47C 27/065; A47C 27/20; A47C 27/142; A47C 27/144
See application file for complete search history.

(56) References Cited

U.S. PATENT DOCUMENTS

| | | | | |
|---|---|---|---|---|
| 2015/0265063 | A1* | 9/2015 | Cappadona | A47C 27/148 5/724 |
| 2020/0229607 | A1* | 7/2020 | Ribicic | A47C 27/064 |
| 2020/0229612 | A1* | 7/2020 | Micklos | A47C 27/148 |
| 2022/0346563 | A1* | 11/2022 | Stojanovic | A47C 27/002 |
| 2023/0092044 | A1* | 3/2023 | Stojanovic | A47C 27/20 |

* cited by examiner

SYSTEM AND METHOD FOR CUSTOMIZING A MATTRESS

CROSS-REFERENCE TO RELATED APPLICATIONS

The present Application is a continuation-in-part of U.S. application Ser. No. 17/562,576, filed on Dec. 27, 2021 and issued as U.S. Pat. No. 12,022,957 on Jul. 2, 2024, all of which is incorporated herein by reference.

FIELD

The present disclosure relates, generally, to a mattress. More particularly, the present disclosure pertains to a multi-layer mattress to facilitate an uneven compression of the mattress when the person lies on the mattress.

BACKGROUND

Mattresses used for sleeping have been made in more or less the same shape and primary materials for many years. Foam mattresses typically use multiple layers of foam having uniform thickness and often times having identical density and firmness throughout the entire thickness of the layers. Accordingly, foam mattresses may lack the ability to ergonomically support the human form or body, especially when considering the natural arcs and curves of the human forms or the tendency for some people to carry extra weight through their hips, waist and stomach area. The disclosed construction method addresses both the need for contouring support and the ability to enhance the strength of support (or resistance to compression) in one or more areas of the mattress.

SUMMARY

In one aspect of the disclosure, a mattress is disclosed. The mattress comprises a first layer and a second layer supported on the first layer and arranged abutting the first layer. The mattress further includes a third layer including a first longitudinal end and a second longitudinal end and having a substantially arch shape. The third layer includes a first portion extending in a longitudinal direction from a location proximate to the first longitudinal end towards the second longitudinal end and completely embedded, in a vertical direction, inside the first layer. The third layer also includes a second portion at least partially embedded inside the second layer. The second portion extends in a longitudinal direction from the first portion towards the second longitudinal end and at least a part of a length of the second portion is completely embedded, in the vertical direction, inside the second layer. The third layer includes one of a plurality of coils arranged in a grid pattern, a plurality of cavities arranged in a grid pattern, a non-woven thermoplastic sheet having heat bonded strands, or a woven thermoplastic sheet having heat bonded strands.

In some additional, alternative, or selectively cumulative embodiments, the mattress further includes a cover layer arranged supported on the second layer such that the second layer is disposed between the first layer and the cover layer.

In some additional, alternative, or selectively cumulative embodiments, the first portion is a first end portion of third layer and the second portion of the third layer includes a second end portion completely embedded inside first layer and a central portion extending from the first end portion to the second end portion, wherein a part length of the central portion is completely embedded inside the cover layer.

In some additional, alternative, or selectively cumulative embodiments, the central portion includes at least one apex portion completely embedded inside the cover layer.

In some additional, alternative, or selectively cumulative embodiments, wherein the at least one apex portion includes a first apex portion and a second apex portion, and the central portion includes a trough portion arranged between the first apex portion and the second apex portion and completely embedded inside the second layer.

In some additional, alternative, or selectively cumulative embodiments, the central portion further includes a first connecting portion connecting the first end portion to the first apex portion and a second connecting portion connecting the second end portion to the second apex portion, wherein the first connecting portion and the second connecting portion are embedded inside the second layer.

In some additional, alternative, or selectively cumulative embodiments, the third layer includes a plurality of pockets and the plurality of coils is arranged inside the plurality of pockets such that one coil is arranged inside one pocket.

In some additional, alternative, or selectively cumulative embodiments, each coil is a helical coil with a central axis of the coil extending in a vertical direction.

In some additional, alternative, or selectively cumulative embodiments, the third layer includes a plurality of first walls arranged spaced apart from each other and a plurality of second walls extending substantially perpendicularly to the plurality of first walls and arranged spaced apart from each other. The plurality of cavities is defined between the plurality of first walls and the plurality of second walls.

In some additional, alternative, or selectively cumulative embodiments, the first walls and the second walls are made of flexible material.

DETAILED DESCRIPTION

Figure 1:
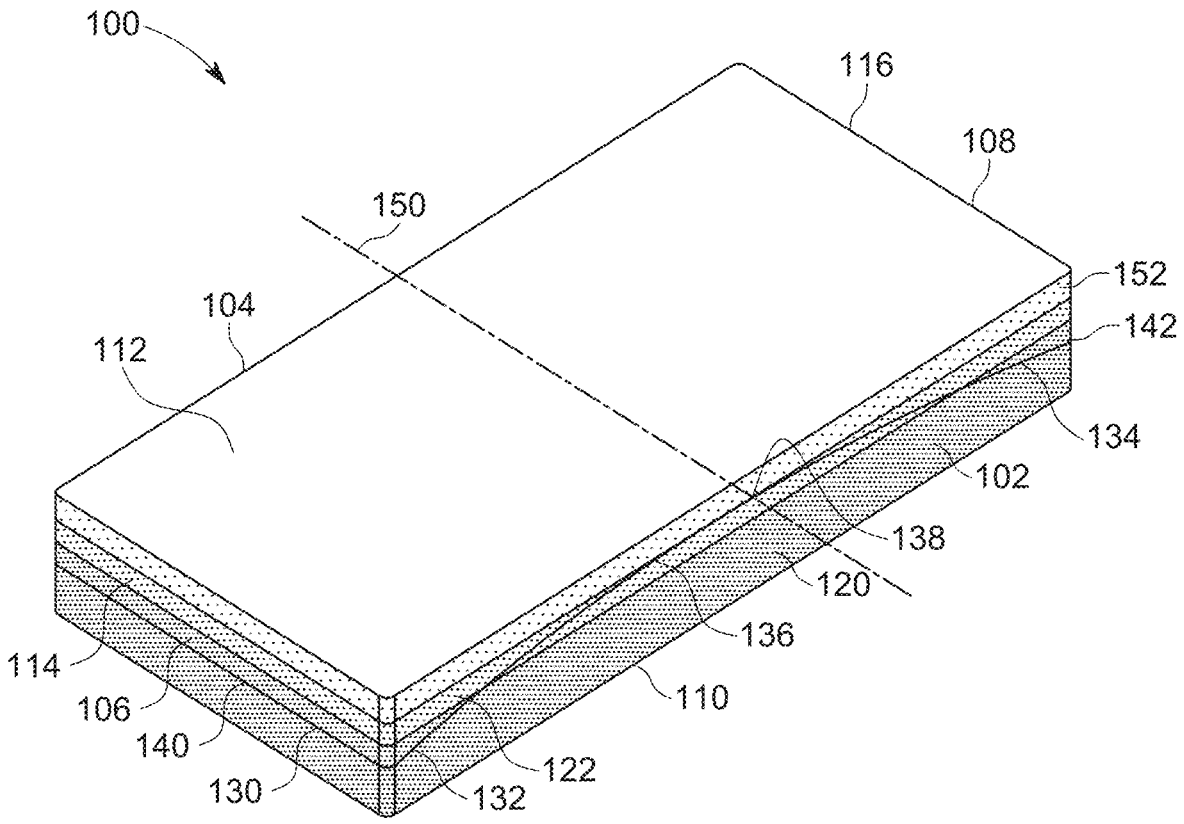
FIG. 1 illustrates a top perspective view of a mattress, in accordance with an exemplary embodiment of the disclosure.

Exemplary embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing exemplary embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc., mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the exemplary embodiments set forth herein. Rather, these exemplary embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

Reference will now be made in detail to specific embodiments or features, examples of which are illustrated in the accompanying drawings. Generally, corresponding reference numbers will be used throughout the drawings to refer to the same or corresponding parts. Also, wherever possible, the same reference numbers will be used throughout the drawings to refer to the same or the like parts.

Figure 2:
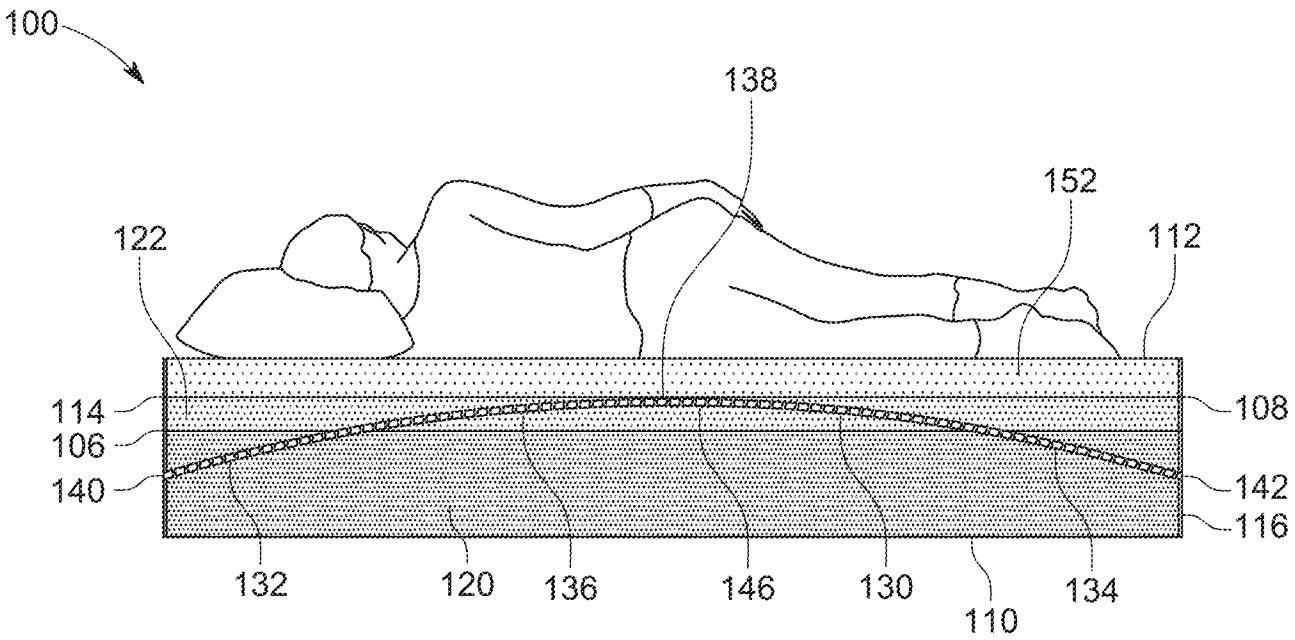
FIG. 2 illustrates a side view of the mattress of FIG. 1, in accordance with an exemplary embodiment of the disclosure.
Figure 3:
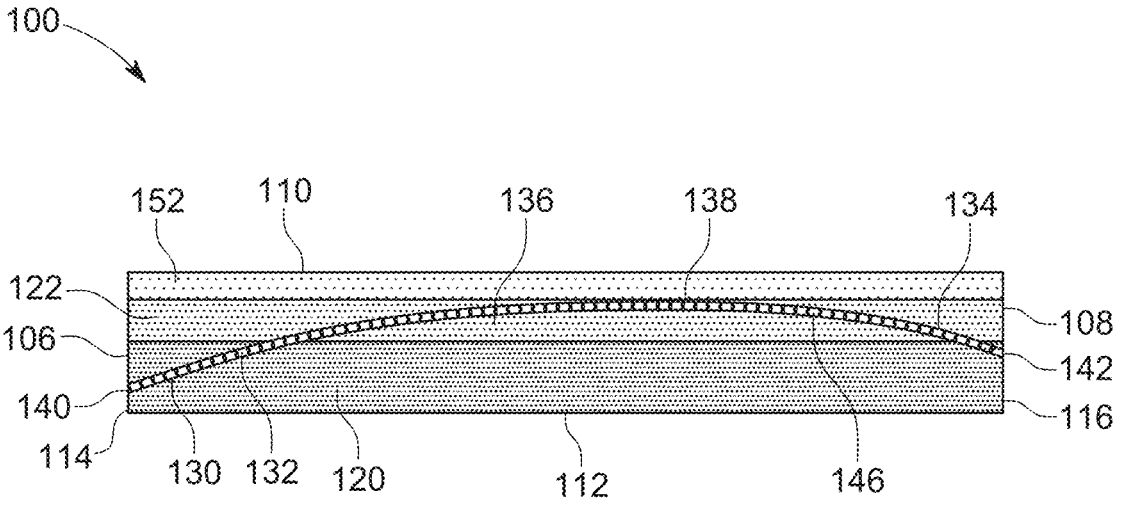
FIG. 3 illustrates a side view of a mattress having an apex of a third layer of the mattress arranged at an offset from a central lateral line of the mattress, in accordance with an exemplary embodiment of the disclosure.

Referring to FIGS. 1 to 3, a mattress 100 is shown according to exemplary embodiments of the disclosure. The mattress 100 may be a rectangular mattress having a pair of longitudinal sides 102, 104 and a pair of lateral sides 106, 108 extending between the pair of longitudinal sides 102, 104. The mattress 100 also includes a first surface 110 adapted to contact a surface, for example, a bed or a ground, and a second surface 112 arranged opposite to the first surface 110. The user lies on the second surface 112 of the mattress 100. Further, the mattress 100 includes a first longitudinal end 114 and a second longitudinal end 116 arranged opposite to the first longitudinal end 114. The longitudinal sides 102, 104 of the mattress 100 extend from the first longitudinal end 114 to the second longitudinal end 116.

As shown, the mattress 100 includes a first layer 120 (i.e., a base layer 120) defining a support layer of the mattress 100 and a second layer 122 arranged contacting the base layer 120 and supported on the base layer 120. In an embodiment, the second layer 122 is adhesively attached to the base layer 120. In some embodiments, the second layer 122 is a soft layer relative to the base layer 120 and may be made of foam, for example, polyurethane form. Similarly, the base layer 120 may also be made of the foam, for example, polyurethane form, or a coconut coir. Both the base layer 120 and the second layer 122 extend from a first longitudinal side 102 to a second longitudinal side 104 of the mattress 100 and extend from a first lateral side 106 to a second lateral side 108 of the mattress 100.

The mattress 100 includes a third layer 130 arranged between the base layer 120 and the second layer 122 and is relatively harder than the second layer 122. In an embodiment, the first layer 120 is harder than the third layer 130, and the third layer 130 is anchored inside the first layer 120. The third layer 130 extends in a curved shape, an arch shape, or a wavy shape, and is arranged partially within the first layer 120 and partially within the second layer 122. As shown, the third layer 130 extends from the first longitudinal end 114 of the mattress 100 to the second longitudinal end 116 of the mattress 100 and includes a first end portion 132 completely embedded inside the first layer 120, a second end portion 134 completely arranged/embedded inside the first layer 120, and a central portion 136 extending from the first end portion 132 to the second end portion 134 and includes at least one apex, for example, an apex 138. The central portion 136 is completely arranged/embedded inside the second layer 122. The second end portion 134 and the central portion 136 together define a second portion of the third layer 130.

Further, the third layer 130 includes a first longitudinal end 140 arranged proximate to or aligned with the first longitudinal end 114 of the mattress 100 and a second longitudinal end 142 arranged proximate to or aligned with the second longitudinal end 116 of the mattress 100. As shown, the first end portion 132 extends from the first longitudinal end 140 to the central portion 136, while the second end portion 134 extends from the second longitudinal end 142 to the central portion 136. Although, the third layer 130 is shown to be extended from the first longitudinal end 114 of the mattress 100 to the second longitudinal end 116 of the mattress 100, it may be envisioned that the first longitudinal end 140 and/or the second longitudinal end 142 of the third layer 130 may be arranged at offset from the first longitudinal end 114 and the second longitudinal end 116 of the mattress 100 respectively.

As shown in FIGS. 1 to 3, the first end portion 132 extends towards the second surface 112 of the mattress 100 from the first longitudinal end 140 in an arch shape such that a distance of a lower surface 146 of the third layer 130 from the first surface 110 increases from the first longitudinal end 142 to the central portion 136. It can be seen that the first end portion 132 is completely embedded or anchored within the base layer 120. Similar to the first end portion 132, the second end portion 134 extends towards the second surface 112 of the mattress 100 from the second longitudinal end 142 in an arch shape such that a distance of the lower surface 146 of the third layer 130 from the first surface 110 of the mattress 100 increases from the second longitudinal end 142 to the central portion 136. It can be seen that the second end portion 134 is completely embedded or anchored within the base layer 120. Although both the first end portion 132 and the second end portion 134 are contemplated and shown to be embedded inside the first layer 120, it may be envisioned that only one of the first end portion 132 and the second end portion 134 may be embedded inside the first layer 120, and other of the first end portion 132 and the second end portion 134 may be embedded inside the second layer 122.

As shown in FIGS. 1 to 3, the third layer 130 includes a substantially convex shape having the central portion 136 completely arranged or embedded inside the second layer 122. Accordingly, the third layer 130 is arranged such that a distance of the lower surface 146 of the third layer 130 increases from the first longitudinal end 140 of the third layer 130 to the apex 138 and then decreases from the apex 138 to the second longitudinal end 142 of the third layer 130. As illustrated in FIGS. 1 and 2, the apex 138 is arranged along a central lateral line 150 of the mattress 100 and the third layer 130 is symmetrically about the central lateral line 150 or the apex 138. In some embodiments, as shown in FIG. 3, the apex 138 is arranged offset from the central lateral line 150 of the mattress, and the third layer 130 may be asymmetrically arranged about the central lateral line 150 and/or the apex 138. In one embodiment, one of the longitudinal ends, for example, the first longitudinal end 140, may be arranged proximate to the first surface 110 of the mattress 100, while other of the longitudinal end, for example, the second longitudinal end 142, is arranged distally from the first surface 110 of the mattress 100 relative to the first longitudinal end 140. In an embodiment, at one of the longitudinal ends 140, 142 of the third layer 100 is arranged at the lower surface (i.e., first surface 110) of the mattress 100. Additionally, or optionally, the mattress 100 may include a cover layer 152 arranged supported on the second layer 122 such that the second layer 122 is arranged between the first layer 120 and the cover layer 152. Although, the third layer 130 is shown to be extending in two adjacent layers, it may be appreciated that the third layer 130 may extend in any number of layers of the mattress 100 including the cover layer 152.

Figure 4:
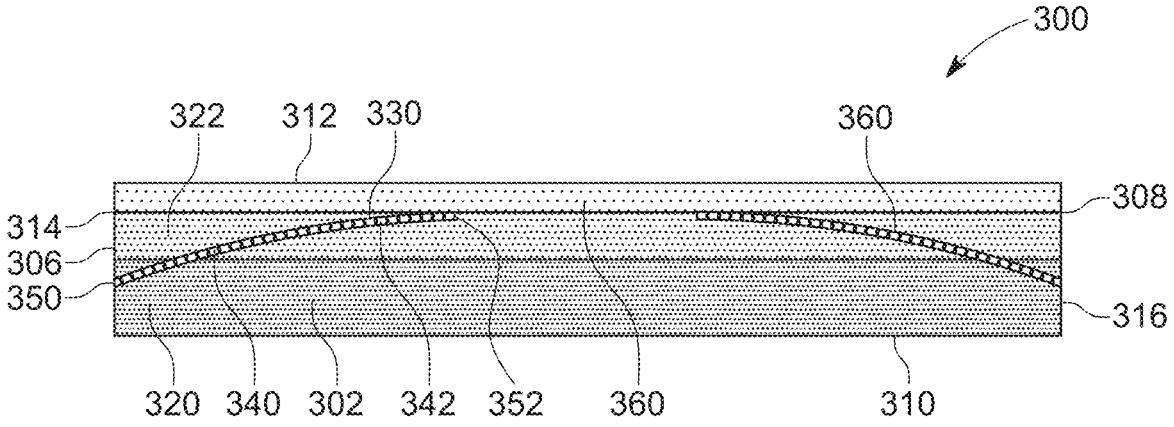
FIG. 4 illustrates a side view of a mattress, in accordance with an exemplary embodiment of the disclosure.

Referring to FIG. 4, a mattress 300 according to an alternative embodiment is shown. The mattress 300 is similar to the mattress 100 except that a third layer 330 of the mattress 300 is different from the third layer 120 of the mattress 100. The mattress 300 includes a first longitudinal side 302, a second longitudinal side (not shown), a first lateral side 306, a second lateral side 308, a first surface 310, a second surface 312, a first longitudinal end 314, and a second longitudinal end 316 similar to the first longitudinal side 102, the second longitudinal side 104, the first lateral side 106, the second lateral side 108, the first surface 110, the second surface 112, the first longitudinal end 114, and the second longitudinal end 116 of the mattress 100 respectively. Moreover, the mattress 300 includes a first layer 320 (i.e., a base layer 320) and a second layer 322 similar to the first layer 120 and the second layer 122 of the mattress 100 respectively.

As shown, the third layer 330 includes a first portion 340 i.e., first end portion 340 disposed proximate to the first lateral side 306 and embedded inside the base layer 320 and a second portion 342 extending upwardly from the first portion 340 and embedded inside the second layer 322. As illustrated, the third layer 330 is in form an arc defining a sector of a circle. As shown, a first end 350 of the third layer 330 is arranged at the first longitudinal end 314 of the mattress 300, while a second end 352 of the third layer 330 of the mattress 300 is arranged proximate to an upper surface of the second layer 322. Accordingly, the second end 352 may define an apex of the third layer 330. Also, the mattress 300 may include a fourth layer 360 similar to the third layer 330. As shown, the third layer 330 and the fourth layer 360 are arranged symmetrically on the opposing sides of a central lateral line of the mattress 300.

Figure 5:
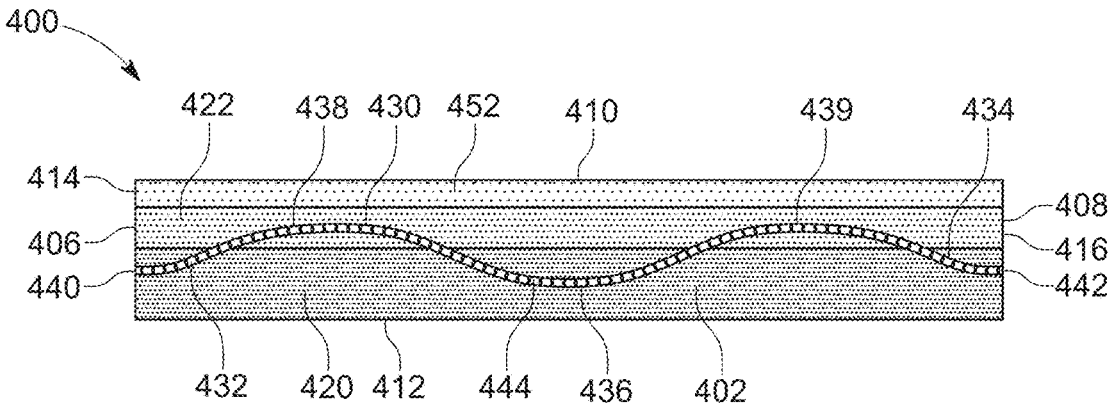
FIG. 5 illustrates a side view of a mattress, in accordance with an exemplary embodiment of the disclosure.

Referring to FIG. 5, a mattress 400 according to an alternative embodiment is shown. The mattress 400 is similar to the mattress 100 except that a third layer 430 of the mattress 400 is different from the third layer 130 of the mattress 100. The mattress 400 includes a first longitudinal side 402, a second longitudinal side, a first lateral side 406, a second lateral side 408, a first surface 410, a second surface 412, a first longitudinal end 414, and a second longitudinal end 416 similar to the first longitudinal side 102, the second longitudinal side 104, the first lateral side 106, the second lateral side 108, the first surface 110, the second surface 112, the first longitudinal end 114, and the second longitudinal end 116 respectively. Moreover, the mattress 400 includes a first layer 420 (i.e., a base layer 420) and a second layer 422 similar to the first layer 120 and the second layer 122 of the mattress 100.

As shown, the third layer 430 includes a wavy shape having a first portion, i.e., a first end portion 432 embedded inside the base layer 420, a second end portion 434 embedded inside the base layer 420, and a central portion 436 arranged between the first end portion 432 and the second end portion 434. Accordingly, the second end portion 432 and the central portion 436 together define the second portion of the third layer 430. The first end portion 432 extends from a first longitudinal end 440 of the third layer 430 to the central portion 436, while the second end portion 434 extends from a second longitudinal end 442 of the third layer 430 to the central portion 436. The first longitudinal end 440 of the third layer 430 may be arranged proximate to or in alignment with the first longitudinal end 414 of the mattress 400 and the second longitudinal end 442 of the third layer 430 may be arranged proximate to or in alignment with the second longitudinal end 416 of the mattress 400.

The central portion 436 may include a plurality of apexes, for example, a first apex 438 and a second apex 439, completely embedded or arranged inside the second layer 422. As shown, the first apex 438 is arranged proximate to the first longitudinal end 440 of the third layer 430, and hence the first longitudinal end 414 of the mattress 400, relative to the second longitudinal end 442 of the third layer 430, and hence the second longitudinal end 416 of the mattress 400. The second apex 439 is arranged at a longitudinal distance from the first apex 438 and may be disposed proximate to the second longitudinal end 442 relative to the first longitudinal end 440. As with the third layer 130, the first end portion 432 and the second end portion 434 are embedded completely inside the first layer 420 and include arcuate shapes. Further, the central portion 436 defines/includes at least one trough arranged between two consecutive apexes, for example, a trough 444 arranged between the first apex 438 and the second apex 439 and embedded inside the base layer 420. Accordingly, the third layer 430 extends towards the second surface 412 of the mattress 400 from the first longitudinal end 414 of the third layer 430 till the first apex 438 in an arc shape, and then extends downwardly, i.e., towards the first surface 410 of the mattress 400 till the trough 444, and in an arch shape. Subsequently, the third layer 430 extends upwardly, i.e., towards the second surface 412 from the trough 444 to the second apex 439 in an arch shape, and then gradually extends downwardly i.e., towards the first surface 410 from the second apex 439 to the second longitudinal end 442 of the third layer 430.

In the illustrated embodiments, the first longitudinal end 440 and the second longitudinal end 442 of the third layer 430 coincide/align with the first longitudinal end 414 and the second longitudinal end 416 of the mattress 400, respectively. However, it may be envisioned that the first longitudinal end 440 and the second longitudinal end 442 of the third layer 430 may be arranged inwardly and at an offset from the first longitudinal end 414 and the second longitudinal end 416 of the mattress 400 respectively. Also, the third layer 430 may be arranged symmetrically or asymmetrically about a central lateral line of the mattress 400. Although both the first end portion 432 and the second end portion 434 are contemplated and shown to be embedded inside the first layer 420, it may be envisioned that only one of the first end portion 432 and the second end portion 434 may be embedded inside the first layer 420, and other of the first end portion 432 and the second end portion 434 may be embedded inside the second layer 422. Additionally, or optionally, the mattress 400 may include a cover layer 452 arranged supported on the second layer 422 such that the second layer 422 is arranged between the first layer 420 and the cover layer 452.

Figure 6:
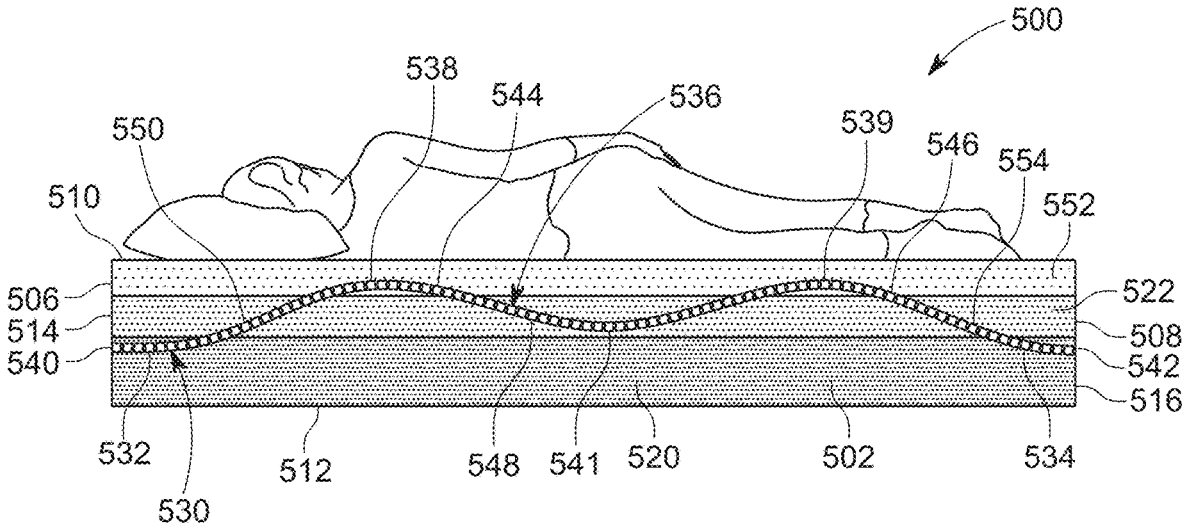
FIG. 6 illustrates a side view of a mattress, in accordance with an exemplary embodiment of the present disclosure.

Referring to FIG. 6, a mattress 500 according to an alternative embodiment is shown. The mattress 500 is similar to the mattress 500 except that a third layer 430 of the mattress 400 is different from the third layer 130 of the mattress 100. The mattress 400 includes a first longitudinal side 502, a second longitudinal side (not shown), a first lateral side 506, a second lateral side 508, a first surface 510, a second surface 512, a first longitudinal end 514, and a second longitudinal end 516 similar to the first longitudinal side 402, the second longitudinal side, the first lateral side 406, the second lateral side 408, the first surface 410, the second surface 412, the first longitudinal end 414, and the second longitudinal end 416 respectively. Moreover, the mattress 500 includes a first layer 520 (i.e., a base layer 420), a second layer 522, and a cover layer 552 similar to the first layer 420, the second layer 422, and the cover layer 452 of the mattress 400. Moreover, the mattress 500 includes a third layer 530 that is different from the third layer 430 of the mattress 400 that third layer 530 also extends in the cover layer.

As shown, the third layer 530 includes a wavy shape having first portion, i.e., a first portion i.e., a first end portion 532 completely embedded inside the base layer 520, a second end portion 534 completely embedded inside the base layer 520, and a central portion 536 arranged between the first end portion 532 and the second end portion 534. Accordingly, the second end portion 532 and the central portion 536 together define the second portion of the third layer 530. The first end portion 532 extends from a first longitudinal end 540 of the third layer 530 to the central portion 536, while the second end portion 534 extends from a second longitudinal end 542 of the third layer 530 to the central portion 536. The first longitudinal end 540 of the third layer 530 may be arranged proximate to or in alignment with the first longitudinal end 514 of the mattress 500 and the second longitudinal end 542 of the third layer 530 may be arranged proximate to or in alignment with the second longitudinal end 516 of the mattress 500.

In the illustrated embodiment, the central portion 536 includes a first apex portion 544, a second apex portion 546, and a trough portion 548 arranged between the first apex portion 544 and the second apex portion 546. As shown, the first apex portion 544 and the second apex portion 546 are completely embedded inside the cover layer 552, while the trough portion 548 is completely embedded inside the second layer 522. Although, the trough portion 548 is shown to be completely embedded inside the second layer 522, it may be appreciated that the trough portion 548 may also extend inside the base layer 520. Moreover, one of the apex portions 544, 546 may be arranged/embedded inside the second layer 522.

Further, the central portion 536 includes a first connecting portion 550 extending from the first end portion 532 to the first apex portion 544 and arranged/embedded inside the second layer 522, and a second connecting portion 554 extending from the second end portion 534 to the second apex portion 546 and arranged/embedded inside the second layer 522. In the illustrated embodiment, the first connecting portion 550 and the second connecting portion 554 are completely embedded inside the second layer 522. However, it may be appreciated that first and second connecting portions 550, 554 may be embedded inside base layer 520 and/or the cover layer 552.

As shown, the first apex portion 544 includes a first apex 538 and the second apex portion 546 includes a second apex 539, with the first apex 538 arranged proximate to the first longitudinal end 540 of the third layer 530 relative to the second longitudinal end 542 of the third layer 530. The second apex 539 is arranged at a longitudinal distance from the first apex 538 and may be disposed proximate to the second longitudinal end 542 relative to the first longitudinal end 540. As with the third layer 430, the first end portion 532 and the second end portion 534 are embedded completely inside the first layer 520. Further, the trough portion defines/includes at least one trough arranged between two consecutive apexes, for example, a trough 541 arranged between the first apex 538 and the second apex 539 and embedded inside the second layer 522.

Accordingly, the third layer 530 extends, in an arch shape, towards the second surface 512 of the mattress 500 from the first longitudinal end 514 of the third layer 530 till the first apex 538, and then extends, in a wavy shape, downwardly, i.e., towards the first surface 510 of the mattress 500 till the trough 54. Subsequently, the third layer 530 extends, in a wavy shape, upwardly, i.e., towards the second surface 512 from the trough 541 to the second apex 539, and then gradually extends, arch shape, downwardly i.e., towards the first surface 510 from the second apex 539 to the second longitudinal end 542 of the third layer 530.

In the illustrated embodiments, the first longitudinal end 540 and the second longitudinal end 542 of the third layer 530 coincide/align with the first longitudinal end 514 and the second longitudinal end 516 of the mattress 500, respectively. However, it may be envisioned that the first longitudinal end 440 and the second longitudinal end 442 of the third layer 530 may be arranged inwardly and at an offset from the first longitudinal end 514 and the second longitudinal end 516 of the mattress 500 respectively. Also, the third layer 530 may be arranged symmetrically or asymmetrically about a central lateral line of the mattress 500. Although both the first end portion 532 and the second end portion 534 are contemplated and shown to be embedded inside the first layer 520, it may be envisioned that only one of the first end portion 532 and the second end portion 534 may be embedded inside the first layer 520, and other of the first end portion 532 and the second end portion 534 may be embedded inside the second layer 522. In such a case, one of the connecting portions of the central portion may be omitted.

Figure 7:
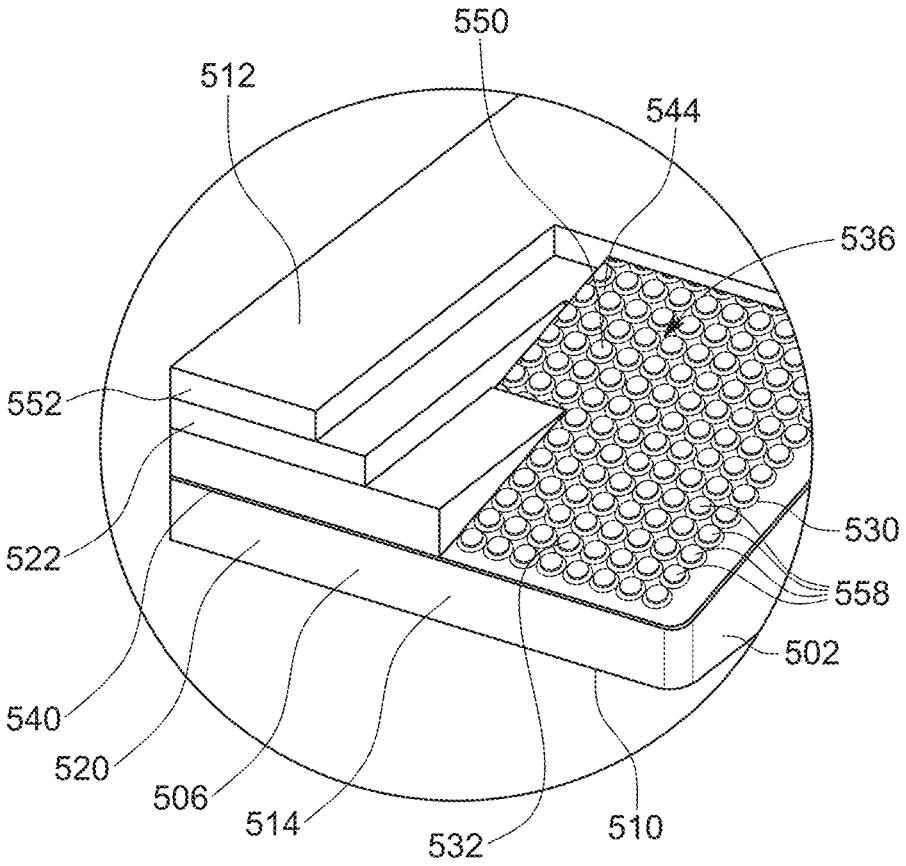
FIG. 7 illustrates a sectional perspective view of a portion of the mattress of FIG. 6, in accordance with an exemplary embodiment of the present disclosure.
Figure 8:
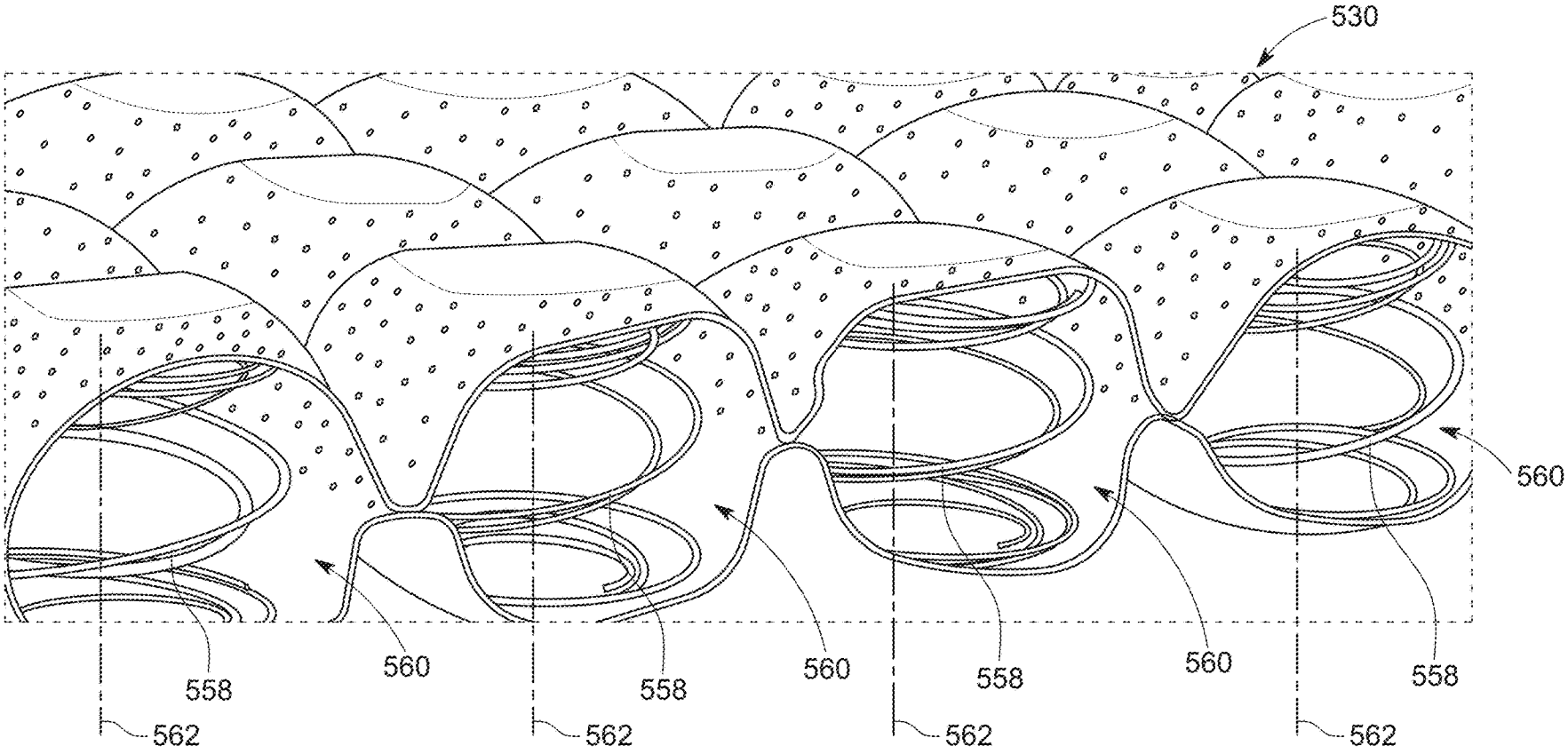
FIG. 8 illustrates a sectional view of a portion of a third layer of the mattress of FIG. 6, in accordance with an exemplary embodiment of the present disclosure.

Referring to FIGS. 7 and 8, structural details of the third layer 530 is shown. The third layer 530 includes a plurality of coils 558 arranged in a grid structure/pattern having a plurality of rows and a plurality of columns. As best shown in FIG. 8, third layer 530 includes a plurality of pockets 560 and the plurality of coils 558 are arranged inside the plurality of pockets 560. As shown, one coil 558 is arranged in one pocket 560, and the pocket 560 is a closed pocket. The coil 558 is a helical coil having single or double helix structure with a central axis 562 of the coil 558 being extending in a vertical direction. For example, central axes 562 of the coils 558 arranged at the first apex 538 may extend substantially perpendicularly to the first surface 510 of the mattress 500. As the coils 558 are arranged in a spring like helical configuration, the coils 558 are adapted to compress under loading, i.e., when the person lies on the mattress 500. Also, the compression of the coils 558 varies depending on the load coming on the coils 558. Accordingly, the coils 558 provide varying compression of the third layer 530 along at least the longitudinal direction of the mattress 500. Although the structural details of the third layer 530 is explained and shown with reference to the mattress 500, it may be appreciated that the third layer 130, 330, 430 may include similar coils. Also, in some embodiments, instead of the coils, the third layer 530 may be a foam layer or a polyurethane layer.

When the user is lying on the mattress 100, 300, 400, 500, the arch shape of the third layer 130, 330, 430, 530 facilitates uneven compression of the mattress 100, 300, 400, 500. As the user lies on the mattress 100, 300, 400, 500 the hips of the user press down the third layer 130, 330, 430, 530 deflecting the third layer 130, 330, 430, 530 arranged below the hip area downwardly. Due to the arch shape of the third layer 130, 330, 430, 530 and anchoring of the first end portion 132, 340, 432, 532 and/or the second end portion 134, 434, 534 inside the first layer 120, 420, 520, a portion of the third layer 130, 330, 430, 530 that is arranged adjacently to the portion of the third layer 130, 330, 430, 530 being pushed downward by the hip area of the user, will have a tendency to move upwardly providing additional support to the lumbar area of the person. When the user is lying on their side, the third layer 130, 430, 530 will push up into the waist—creating a bit of a cradling effect.

Figure 9:
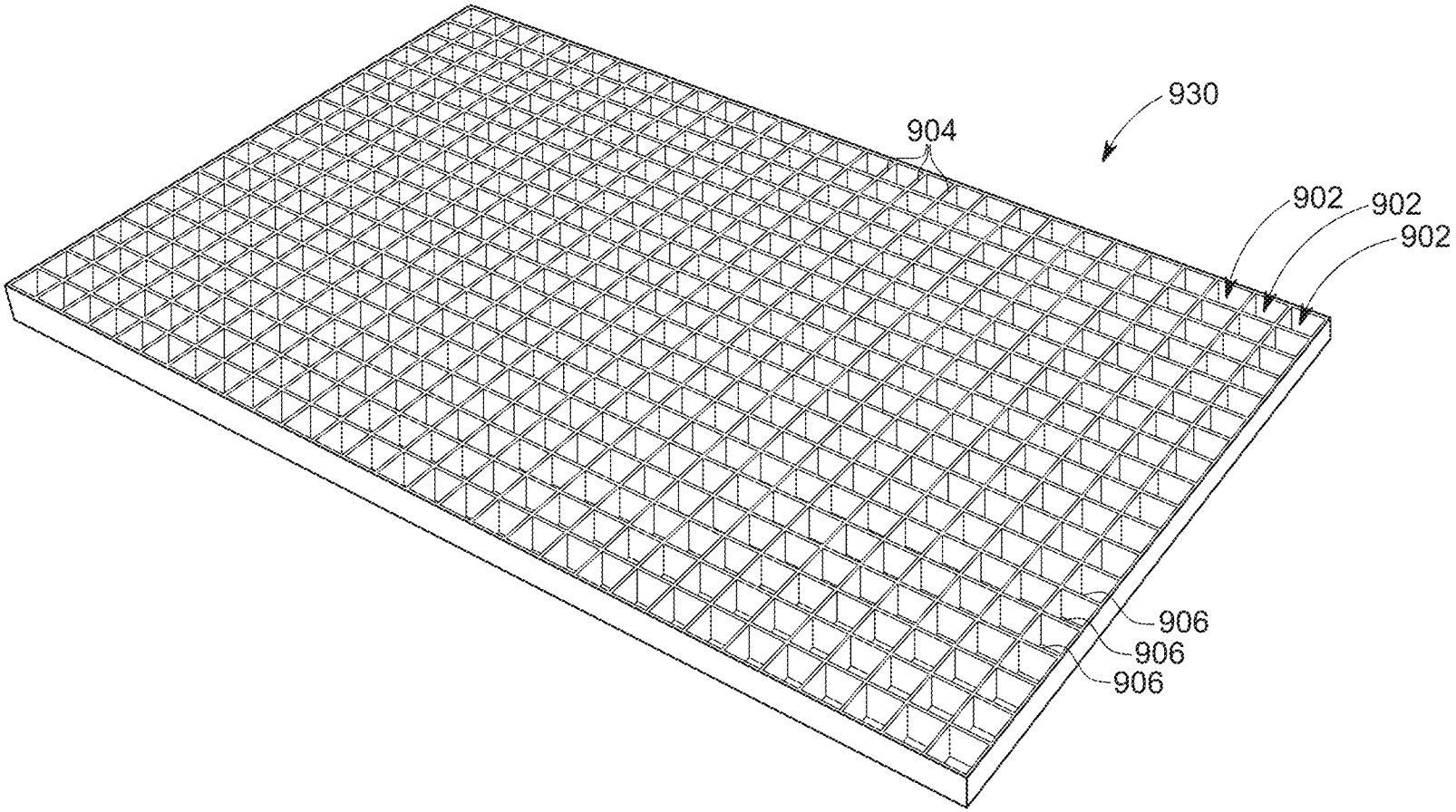
FIG. 9 illustrates a top perspective view of a third layer, in accordance with an exemplary embodiment of the present disclosure.

Referring to FIG. 9, a third layer 930 according to an alternative embodiment is shown. The third layer 930 is made of flexible material, for example, rubber, and includes a plurality of cavities 902 arranged in a grid structure/pattern having a plurality of columns and a plurality of rows. As shown, the third layer 900 includes a plurality of first walls 904 extending in a lateral direction and arranged spaced apart and substantially parallel to each other, and a plurality of second walls 906 extending in the longitudinal direction and arranged spaced apart from each other and intersecting the plurality of first walls 904 defining the plurality of cavities 902. As show, the cavities 902 extend from an upper surface of the third layer 930 to the lower surface of the third layer 900, and the walls 904, 906 are made of a flexible material, such as, but not limited to, rubber. The grid configuration of the cavities 902 and the walls 904, 906 of third layer 930 along with the flexible material provides greater flexibility to bend under loading and provide differential bending at various locations under differential loading when the person lies on a mattress.

Figure 10:
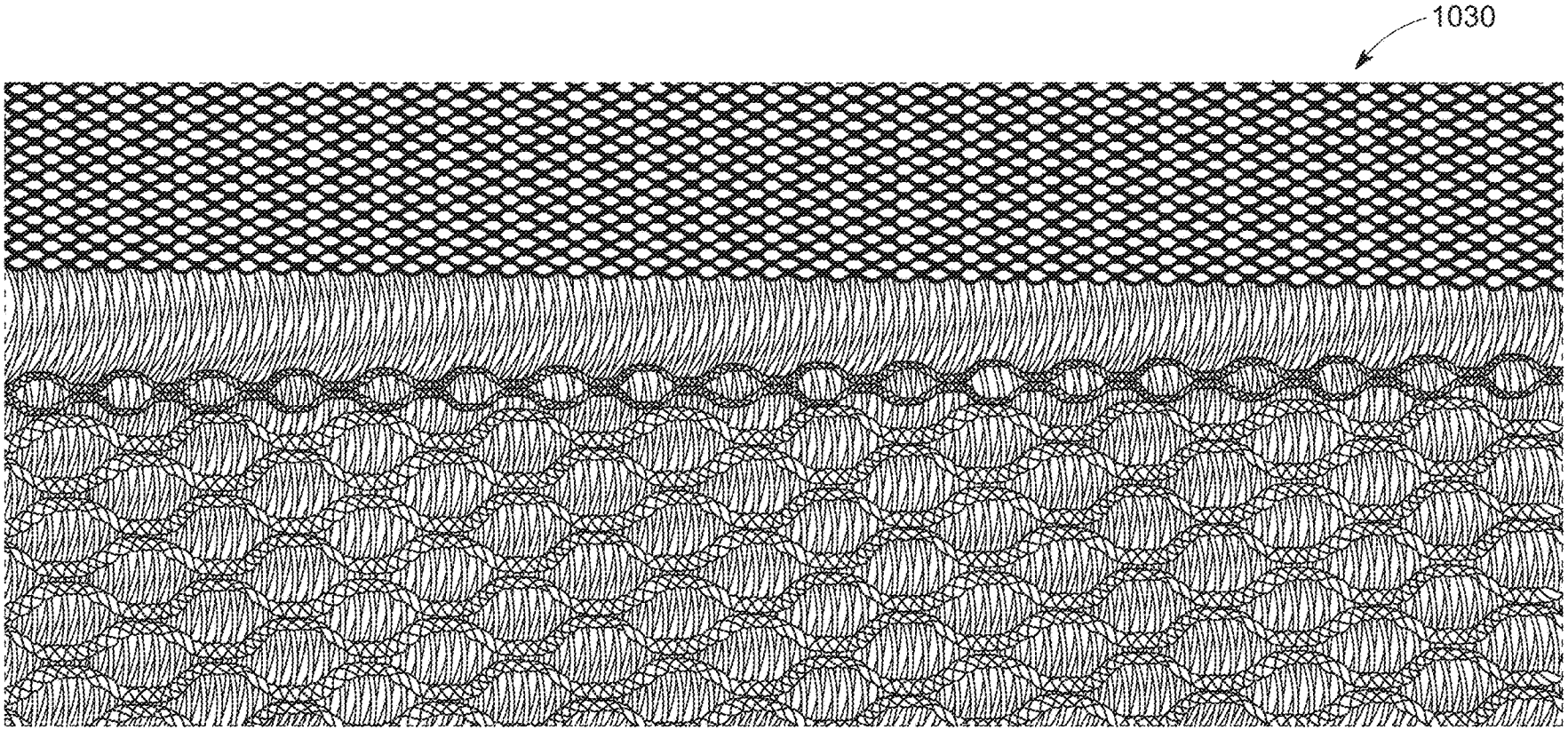
FIG. 10 illustrates a side perspective view of a third layer, in accordance with an exemplary embodiment of the present disclosure.

Referring to FIG. 10, a third layer 1030 according to yet another embodiment is shown. The third layer 1030 is a woven thermoplastic layer/sheet including heat bonded strands.

Figure 11:
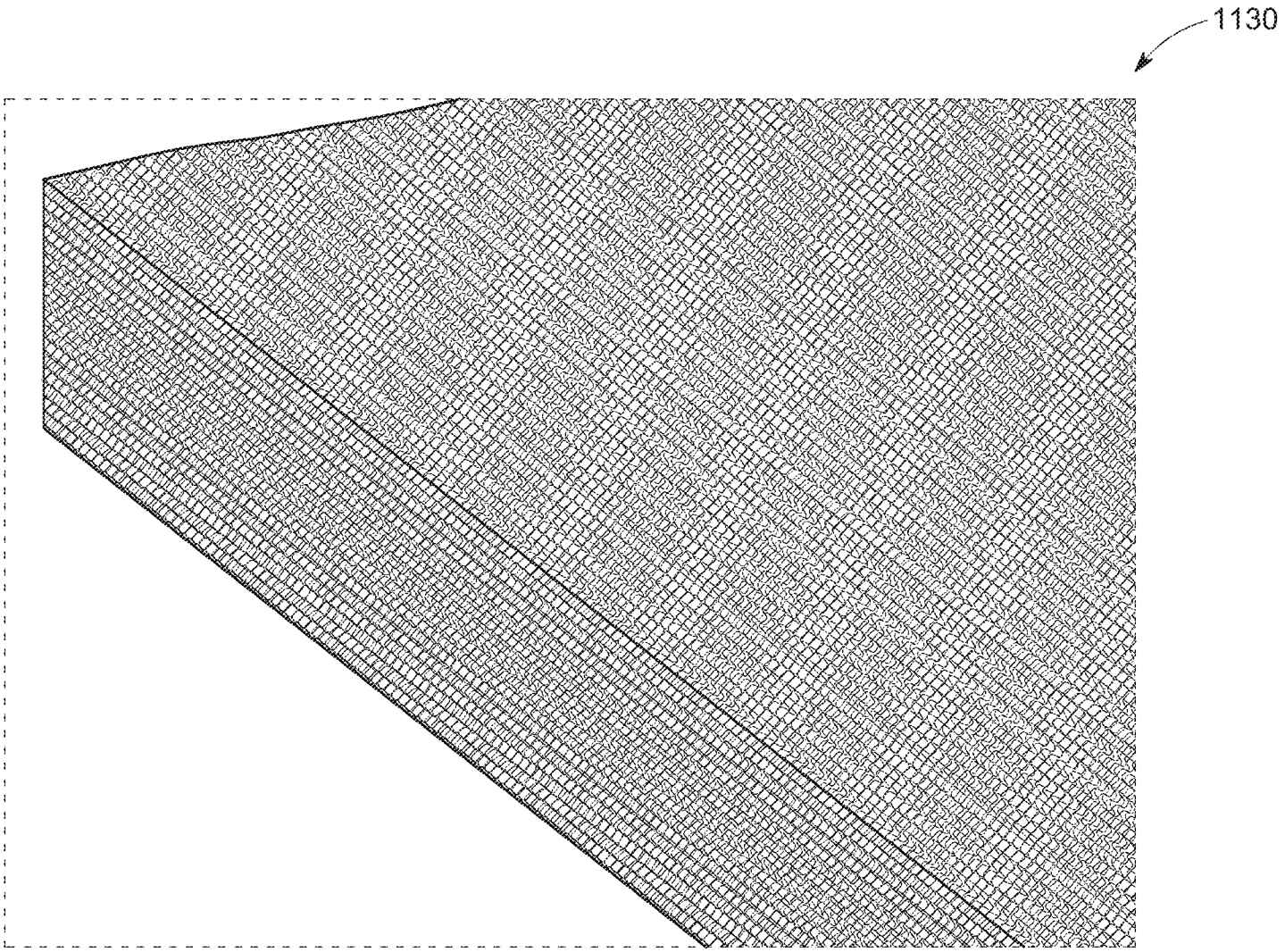
FIG. 11 illustrates a side perspective view of a third layer, in accordance with an exemplary embodiment of the present disclosure.

Referring to FIG. 11, a third layer 1130 according to a further embodiment is shown. The third layer 1130 is a non-woven thermoplastic layer sheet including heat bonded strands.

In some embodiments, the third layer 130, 330, 430 may be a foam layer or a polyurethane layer.

Like numbers refer to like elements throughout. Thus, the same or similar numbers may be described with reference to other drawings even if they are neither mentioned nor described in the corresponding drawing. Also, elements that are not denoted by reference numbers may be described with reference to other drawings.

It should be understood that the foregoing description is only illustrative of the aspects of the disclosed embodiments. Various alternatives and modifications can be devised by those skilled in the art without departing from the aspects of the disclosed embodiments. Accordingly, the aspects of the disclosed embodiments are intended to embrace all such alternatives, modifications, and variances that fall within the scope of the appended claims. Further, the mere fact that different features are recited in mutually different dependent or independent claims does not indicate that a combination of these features cannot be advantageously used, such as a combination remaining within the scope of the aspects of the disclosed embodiments.

Various aspects of the disclosure have been described above. It should be apparent that the teachings herein may be embodied in a wide variety of forms and that any specific structure, function, or both being disclosed herein is merely representative. Based on the teachings herein one skilled in the art should appreciate that an aspect disclosed herein may be implemented independently of any other aspects and that two or more of these aspects may be combined in various ways. For example, an apparatus may be implemented or a method may be practiced using any number of the aspects set forth herein. In addition, such an apparatus may be implemented or such a method may be practiced using other structure, functionality, or structure and functionality in addition to or other than one or more of the aspects set forth herein.

What is claimed is:

1. A mattress, comprising:

a first layer;

a second layer supported on the first layer and arranged abutting the first layer; and a third layer including a first longitudinal end and a second longitudinal end and having a substantially arch shape, the third layer including a first portion extending in a longitudinal direction from a location proximate to the first longitudinal end towards the second longitudinal end and completely embedded, in a vertical direction, inside the first layer, and a second portion extending in a longitudinal direction from the first portion towards the second longitudinal end and at least a part of a length of the second portion is completely embedded, in the vertical direction, inside the second layer, wherein the third layer includes one of a plurality of coils arranged in a grid pattern, a plurality of cavities arranged in a grid pattern, a non-woven thermoplastic sheet having heat bonded strands, or a woven thermoplastic sheet having heat bonded strands.

2. The mattress of claim 1 further including a cover layer arranged supported on the second layer such that the second layer is disposed between the first layer and the cover layer.

3. The mattress of claim 2, wherein the first portion is a first end portion of third layer and the second portion of the third layer includes a second end portion completely embedded inside first layer and a central portion extending from the first end portion to the second end portion, wherein a part length of the central portion is completely embedded inside the cover layer.

4. The mattress of claim 3, wherein the central portion includes at least one apex portion completely embedded inside the cover layer.

5. The mattress of claim 4, wherein the at least one apex portion includes a first apex portion and a second apex portion, and the central portion includes a trough portion arranged between the first apex portion and the second apex portion and completely embedded inside the second layer.

6. The mattress of claim 5, wherein the central portion further includes a first connecting portion connecting the first end portion to the first apex portion and a second connecting portion connecting the second end portion to the second apex portion, wherein the first connecting portion and the second connecting portion are embedded inside the second layer.

7. The mattress of claim 1, wherein the third layer includes a plurality of pockets and the plurality of coils is arranged inside the plurality of pockets such that one coil is arranged inside one pocket.

8. The mattress of claim 7, wherein each coil is a helical coil with a central axis of the coil extending in a vertical direction.

9. The mattress of claim 1, wherein the third layer includes a plurality of first walls arranged spaced apart from each other and a plurality of second walls extending substantially perpendicularly to the plurality of first walls and arranged spaced apart from each other, wherein the plurality of cavities is defined between the plurality of first walls and the plurality of second walls.

10. The mattress of claim 9, wherein the first walls and the second walls are made of flexible material.

* * * * *